US006709684B2

(12) United States Patent
Loth

(10) Patent No.: US 6,709,684 B2
(45) Date of Patent: Mar. 23, 2004

(54) RECLOSABLE PACKAGE

(75) Inventor: Jeffrey Loth, Randolph, NJ (US)

(73) Assignee: Cadbury Adams USA LLC, Wilmington, DE (US)

( * ) Notice: Subject to any disclaimer, the term of this patent is extended or adjusted under 35 U.S.C. 154(b) by 0 days.

(21) Appl. No.: 10/047,606

(22) Filed: Jan. 16, 2002

(65) Prior Publication Data

US 2002/0063079 A1 May 30, 2002

Related U.S. Application Data

(63) Continuation of application No. 09/585,903, filed on Jun. 2, 2000.

(51) Int. Cl.[7] ..... B65D 85/72
(52) U.S. Cl. ..... 426/5; 206/37; 206/800
(58) Field of Search ..... 206/256, 268, 206/387.1, 387.4, 387.15, 558, 800, 37, 460; 220/839, 844; 426/5

(56) References Cited

U.S. PATENT DOCUMENTS 2,263,255 A * 11/1941 West ..... 206/558
2,380,367 A * 7/1945 Ranney ..... 206/449
2,973,273 A * 2/1961 Curtiss ..... 426/5
2,988,209 A * 6/1961 Parrilla ..... 206/800
3,039,671 A * 6/1962 Chiamardas ..... 206/256
3,201,258 A * 8/1965 Mastella ..... 426/5
3,756,383 A * 9/1973 Kryter ..... 206/387.14
3,858,788 A * 1/1975 Phillips, Jr. ..... 206/268
4,117,931 A * 10/1978 Berkman ..... 206/561
4,201,298 A 5/1980 Larson et al.
4,233,326 A * 11/1980 Sontag ..... 206/800
4,615,464 A * 10/1986 Byrns ..... 220/844
4,779,756 A * 10/1988 Buelens et al. ..... 220/839
5,029,712 A * 7/1991 O'Brien et al. ..... 229/87.05
5,353,956 A * 10/1994 Wilson ..... 206/800
5,405,007 A * 4/1995 Iwahashi ..... 206/387.1
5,441,150 A 8/1995 Ma
5,630,508 A * 5/1997 Petit ..... 206/387.1
5,632,378 A * 5/1997 Provost ..... 206/460
5,636,732 A * 6/1997 Gilels et al. ..... 206/37
5,783,266 A * 7/1998 Gehrke ..... 206/800
6,230,931 B1 * 5/2001 Mandle et al. ..... 221/247
6,257,436 B1 7/2001 McGlauflin

* cited by examiner

*Primary Examiner*—Jim Foster
(74) *Attorney, Agent, or Firm*—Watov & Kipnes, P.C.

(57) ABSTRACT

A reclosable package for storing elongated items, such as one or more sticks of chewing gum, includes a container having an opening for accessing an interior region of the container. The container has sidewalls that surround the interior region of the container and that extend from the opening toward a bottom wall of the container. The reclosable package also has one or more dividers disposed in the interior region of the container and extending between the container opening and the bottom wall. The one or more dividers define elongated slots adapted for receiving the elongated items in an upright orientation. A cap is hingedly connected to one of the sidewalls of the container. The cap is movable between a closed position in which the cap covers the elongated items stored in the container and an open position wherein the elongated items are accessible through the opening of the container. In certain preferred embodiments, the one or more dividers include a first set of spaced ribs extending from an interior surface of a first side wall toward an interior surface of a second opposing sidewall. In other embodiments, spaced ribs extend from two or more opposing sidewalls.

31 Claims, 16 Drawing Sheets

RECLOSABLE PACKAGE

This is a continuation of Ser. No. 09/585,903 filed on Jun. 2, 2000.

FIELD OF THE INVENTION

This invention generally relates to the field of material packaging and more specifically relates to reclosable packages for confectionery items, such as sticks of chewing gum.

BACKGROUND OF THE INVENTION

When packaging confectionery items, particularly sticks of gum, it has been customary to package the individual sticks of gum in a flexible package. These flexible packages are typically opened by pulling a narrow strip or cord that is wrapped around one end of the package so as to tear off the end of the package. After the package has been opened, the torn-off end of the package and the cord are no longer useful and must be discarded. As a result, once a flexible gum package has been opened, the package cannot be resealed or reclosed. This is because there is no lid or cap to reclose the package. Moreover, the package must be maintained in an upright position to keep the remaining sticks of gum from falling out of the package.

One solution to the above-mentioned problems is disclosed in U.S. Pat. No. 5,638,378 which provides an adhesive at a closed end of an opened package to retain individual sticks of gum in the package. However, this solution has often proven to be unsatisfactory and inconvenient because after the package is opened, the sticks of gum remain exposed to the elements. As a result, the exposed sticks of gum lose their freshness after a short period of time.

Another solution to the above-mentioned problems is disclosed in commonly assigned U.S. Pat. No. 5,125,211, the disclosure of which is hereby incorporated by reference herein. In the '211 patent, the package is a reclosable package that includes a container having a front portion, a top end portion and a back portion. An adhesive front label is applied to the front portion of the container and a flexible adhesive flap including a non-adhesive pull tab is provided for covering the label, the top end and the back portions of the container. The label and front portion of the container preferably has a contour edge formed therein to define an opening edge. During operation, lifting the pull-tab detaches the front portion along the contour edge and also removes the top end to open the package. The back of the flap remains attached to the back of the package to form a hinged connection. The flap is resealable to the front portion of the package to allow the package to be reclosed.

U.S. Pat. No. 5,636,732 discloses a cap for a package of chewing gum. The cap is placed over an open end of the package and has a frame which surrounds the open end. The frame has two windows, each of which is juxtaposed with a group of chewing gum sticks stored in the package. A pair of covers for the two windows is pivotally mounted on the frame of the cap. When it is desired to remove a stick of chewing gum from the package, one of the covers is opened to expose the ends of a first group of chewing gum sticks. Once a chewing gum stick has been removed, the cover may be closed by snapping the lip of one of the covers over a cooperating lip on the frame.

SUMMARY OF THE INVENTION

In certain preferred embodiments of the present invention, a reclosable package for containing one or more elongated items, such as one or more sticks of chewing gum, includes a container having a bottom wall and sidewalls extending from the bottom wall. The sidewalls preferably surround an interior region of the container and have upper ends that are remote from the bottom wall. The upper ends of the sidewalls define an opening of the container through which one or more of the elongated items may be placed. In one preferred embodiment, the sidewalls include a front wall, a rear wall opposite the front wall, and first and second sidewalls that oppose one another. The front and rear walls preferably include respective interior surfaces that confront one another and the first and second sidewalls preferably extend between the front wall and the rear wall. In preferred embodiments, the distance between the bottom wall and the upper end of the rear wall is greater than the distance between the bottom wall and the upper end of the front wall. In other words, the rear wall has a greater height than the front wall. As a result, upper ends of the opposing sidewalls slope in a downward direction between the rear wall and the front wall.

The reclosable package also includes one or more dividers disposed in the interior region of the container. The one or more dividers preferably extend between the opening of the container and the bottom wall. The opening of the container is preferably located at the upper ends of the front and rear walls. The one or more dividers define elongated slots adapted for receiving one or more elongated items, such as one or more sticks of chewing gum. In certain preferred embodiments, the one or more dividers include a first set of spaced ribs that are attached to and extend from the interior surface of the front wall toward the rear wall. The reclosable package may also include a second set of spaced ribs that oppose the first set of spaced ribs. The second set of spaced ribs is preferably attached to the interior surface of the rear wall and extends from the interior surface of the rear wall toward the front wall. Thus, the ribs of the first and second set preferably oppose one another. The ribs of the first set of ribs are preferably in substantial alignment with the ribs of the second set of ribs, thereby forming a series of elongated slots defined by the opposing ribs. The ribs are preferably integrally formed with the respective interior surfaces of the front and rear walls and preferably extends about 1–3 mm from the respective interior surfaces. In certain preferred embodiments, the first and second sets of ribs extend from the upper ends of the respective front and rear walls to the bottom wall. However, in other preferred embodiments, the ribs may only be provided on either the front wall or the rear wall. The ribs may also extend only part of the way between the upper ends of the front and rear walls and the bottom wall.

The reclosable package also preferably includes a cap attached to the container that is closable over the opening of the container. The cap preferably includes a top wall, a cap front wall extending from a front edge of the top wall, a cap rear wall extending from a rear edge of the top wall and first and second cap sidewalls extending between the cap front wall and the cap rear wall. The cap is generally attached to one of the sidewalls of the container such as the upper end of one of the sidewalls. In preferred embodiments, the cap is hingedly secured to one of the upper ends of one of the sidewalls of the container. In preferred embodiments, the cap is hingedly secured to the upper end of the rear wall of the container. In highly preferred embodiments the cap and the container are molded together as one piece and are integrally connected together via an integrally molded hinge. The integrally molded hinge is preferably a flexible polymer material. In other preferred embodiments, the cap rear wall and the rear wall of the container include tubular elements having axial bores extending therethrough. During assembly of the cap to the container, the respective tubular elements are intermesh with one another so that the axial bores of all of the tubular elements are in substantial alignment with one another. An elongated rod may then be passed through the aligned axial bores for hingedly connecting the cap to the container. As a result, the cap may move between a closed position and a fully open position by pivoting about the elongated rod.

As mentioned above, the ribs formed on the interior surfaces of the front and rear walls provide elongated slots adapted for receiving one or more elongated items such as sticks of chewing gum. The ribs maintain the sticks of chewing gum in an upright position, even after one or more sticks of gum have been removed from the interior region of the container. Thus, the ribs prevent sticks of gum from falling to the side, shifting or moving within the interior region of the container after one or more sticks of gum have been removed from the package.

When the reclosable package is in the closed position, the top wall of the cap overlies the bottom wall of the container and is substantially parallel to the bottom wall of the container. In this closed position, the exterior surface of the top wall overlies the bottom wall and is substantially parallel to the bottom wall of the container. When the cap is in the fully open position, the top wall of the cap does not overlie the bottom wall of the container and the exterior surface of the top wall faces toward the bottom wall of the container.

The height of the cap front wall is greater than the height of the cap rear wall. As a result, the lower ends of the cap sidewalls (i.e., the ends of the sidewalls remote from the top wall of the cap) slope between the cap front wall and the cap rear wall. The slope of the lower ends of the cap sidewalls substantially mirrors the slope of the upper ends of the container sidewalls. When the cap is in the closed position, the lower end of the cap front wall engages the upper end of the container front wall. In addition, the lower ends of the cap sidewalls engage the upper ends of the container sidewalls. The close engagement of the lower ends of the cap walls with the upper ends of the container walls provides a seal when the cap is in the closed position; thereby limiting the exposure of the elongated items stored within the container.

In certain preferred embodiments, the lower end of the cap front wall includes a vertically extending flange that projects from the lower end of the cap front wall and that is engagable with a recess formed on the interior surface of the front wall of the container. The engagement of the vertically extending flange with the recess holds the cap in the closed position. Thus, the recess formed in the interior surface of the front wall is preferably adapted for receiving the vertically extending flange projecting from the lower end of the cap front wall. The cap front wall may also include a horizontally extending flange projecting from the exterior surface of the cap front wall. The horizontally extending flange is engagable for grasping the cap when the cap is moved between the open and closed positions.

In certain preferred embodiments, the cap is preferably hingedly connected to the container by a hinge subassembly. The hinge subassembly preferably includes one or more tubular elements connected to the lower end of the cap rear wall, and one or more tubular elements connected to the upper end of the rear wall of the container. Each tubular element includes an elongated axial bore extending therethrough. During assembly of the cap with the container, the elongated bores of the tubular elements are placed in substantial alignment with one another and an elongated rod is passed through the elongated bores of the tubular elements for hingedly connecting the cap to the rear wall of the container. As a result, the cap may swing between the fully closed position. As mentioned above, the cap may also be hingedly connected to the container by a hinge integrally molded at one end to the cap and at the other end to the container.

DETAILED DESCRIPTION OF THE PREFERRED EMBODIMENTS

Figure 1:
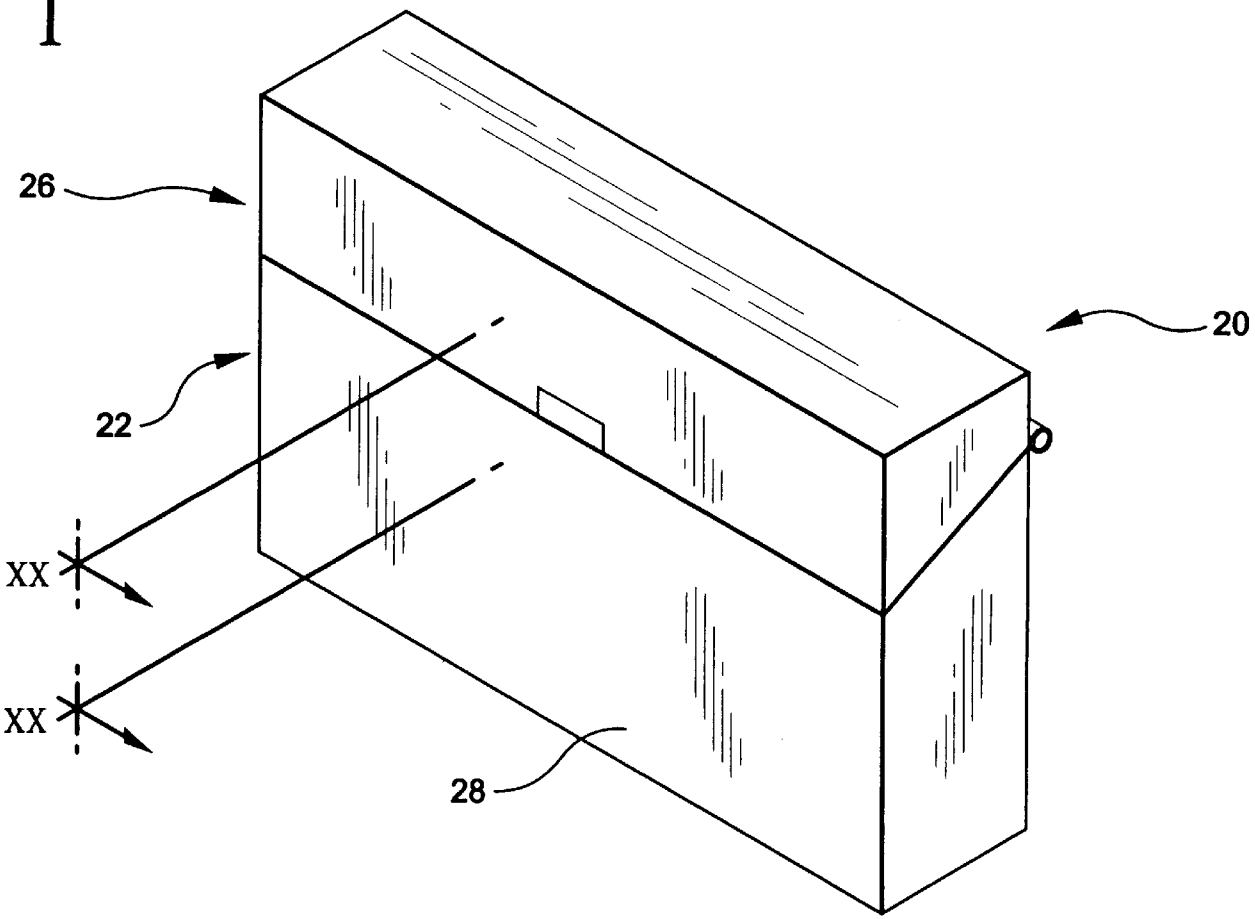
FIG. 1 shows a perspective view of a reclosable package including a container and a cap hingedly connected to the container, in accordance with certain preferred embodiments of the invention.
Figure 2:
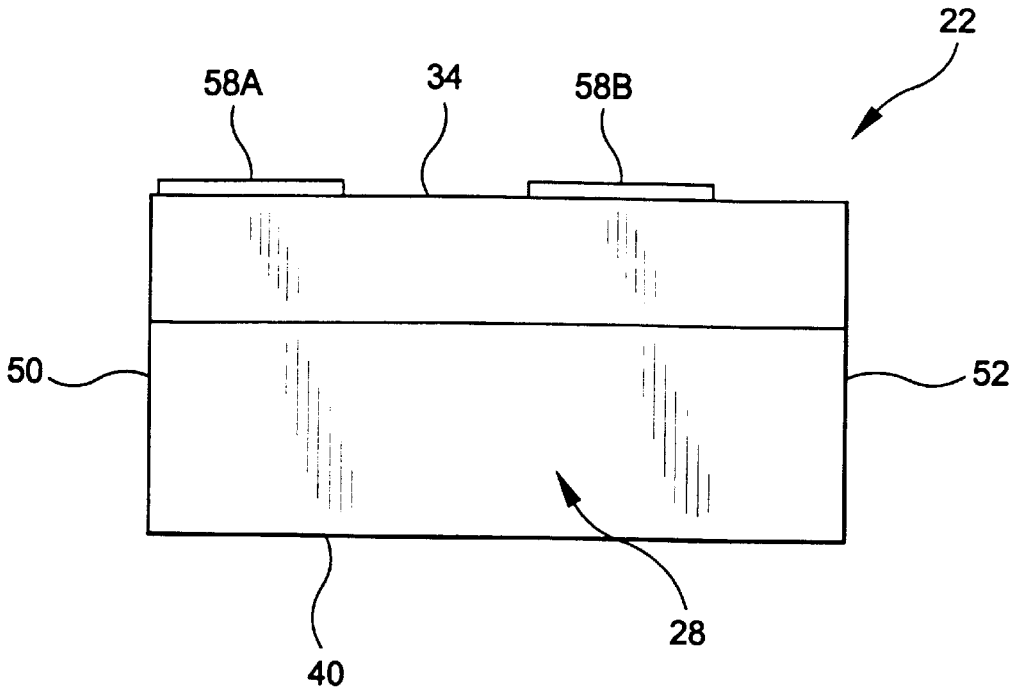
FIG. 2 shows a front view of the container of FIG. 1.
Figure 3:
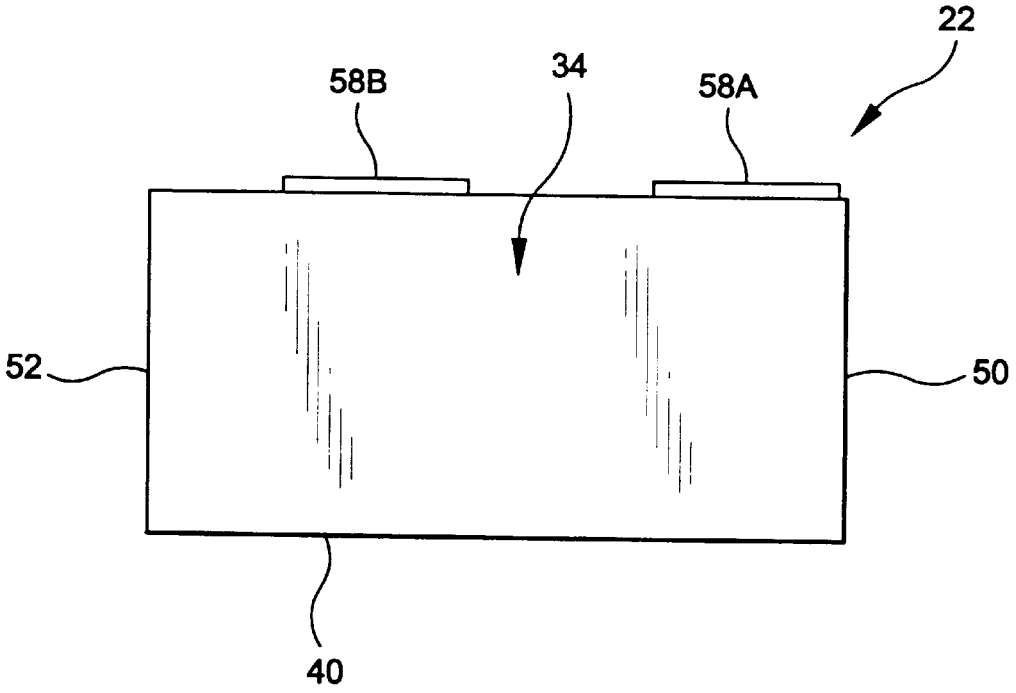
FIG. 3 shows a rear view of the container of FIG. 2.

FIG. 1 shows a perspective view of a reclosable package 20 for storing one or more elongated items in accordance with certain preferred embodiments of the present invention. The reclosable package 20 includes a container 22 having an opening 24 for receiving the one or more elongated items (FIG. 6) and a cap 26 hingedly connected to the container 22. Referring to FIGS. 1–6, the container 22 includes a front wall 28 having an exterior surface 30 and an interior surface 32. The container 22 also includes a rear wall 34 having an exterior surface 36 and an interior surface 38. The container 22 also has a bottom wall 40. The front wall 28 projects from a front edge 42 of bottom wall 40 and the rear wall 34 extends from a rear edge 44 of bottom wall 40. The distance $D_1$ between an upper end 46 of rear wall 34 and the rear edge 44 of bottom wall 40 is greater than the distance $D_2$ between an upper end 48 of front wall 28 and the front edge 42 of bottom wall 40. The container 22 also includes first sidewall 50 and second sidewall 52. The first and second sidewalls 50 and 52 oppose one another and extend between the front wall 28 and rear wall 34 of container 22. Referring to FIG. 6, the interior surface 32 of front wall 28 includes a first set of ribs 54. The first set of ribs 54 are preferably attached to the interior surface 32 of the front wall 28 and extend from the front wall 28 toward rear wall 34. The rear wall 34 preferably includes a second set of ribs 56 attached to the interior surface 38 thereof, the second set of ribs 56 extending toward the front wall 28. The first and second sets of ribs 54 and 56 are preferably integrally formed to the respective front and rear walls of the container. In certain preferred embodiments, the ribs extend approximately one to three millimeters from the respective front and rear walls 28 and 34.

Referring to FIGS. 2–5, in certain preferred embodiments the rear wall 34 of the container includes one or more tubular shaped elements 58A, 58B connected to the upper end 46 of the rear wall. Each tubular shaped element has a central bore 60A, 60B extending therethrough. The central bores 60A, 60B of tubular elements 58A, 58B are preferably in substantial alignment with one another so that a single elongated rod may pass through both of the central bores 60A, 60B.

Figure 5:
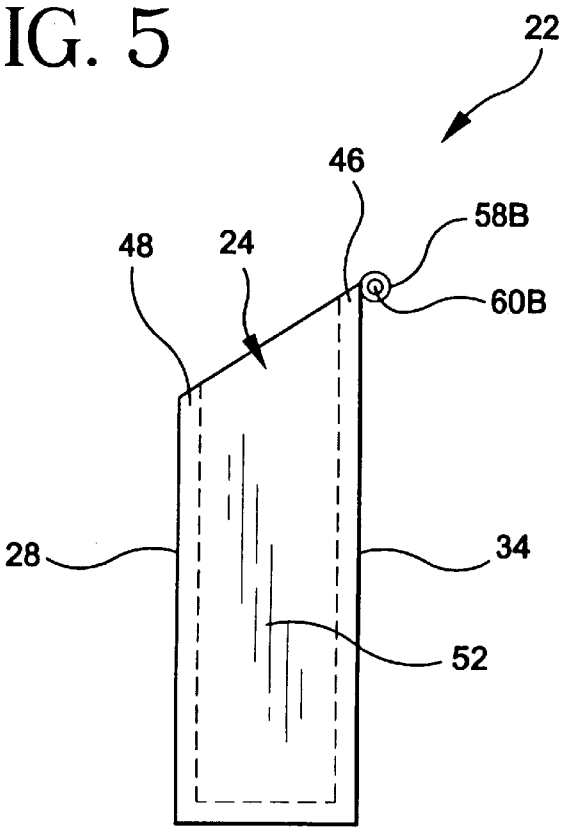
FIG. 5 shows a right side view of the container of FIG. 2.
Figure 4:
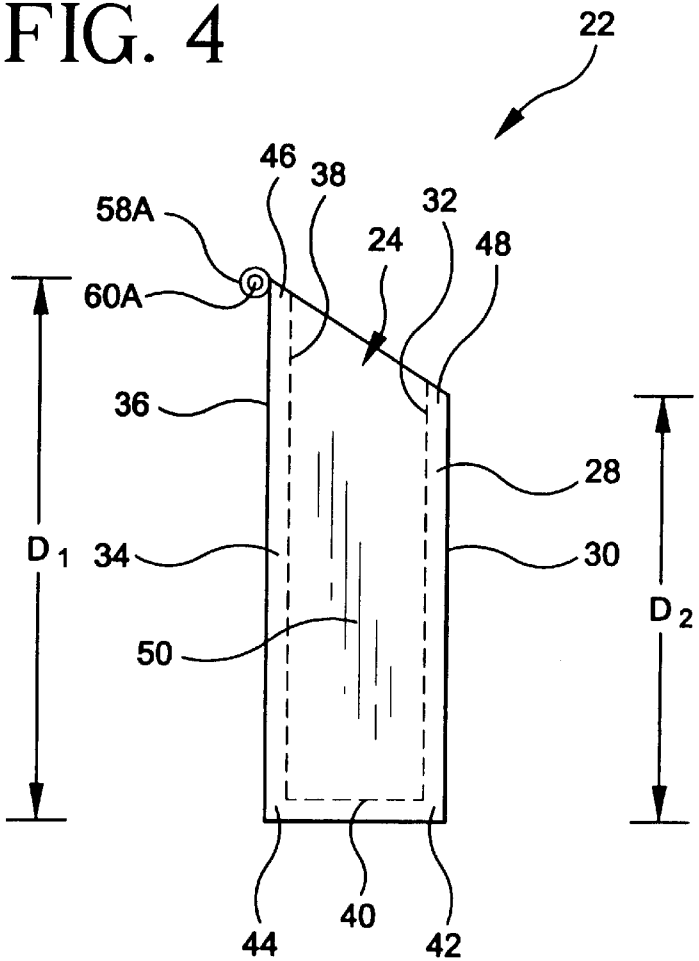
FIG. 4 shows a left side view of the container of FIG. 2.
Figure 6:
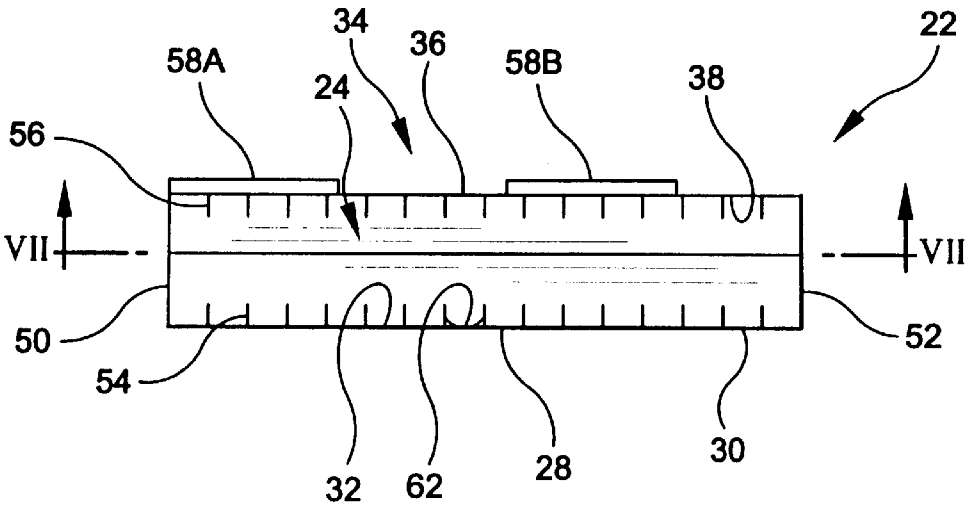
FIG. 6 shows a top view of the container of FIGS. 2–5.

Referring to FIGS. 4 and 5, because the rear wall 34 has a greater height than the front wall 28, the upper ends of the first and second sidewalls 50, 52 slope in a downward direction between the rear wall 34 and the front wall 28. In certain preferred embodiments, the upper ends of the first and second sidewalls 50 and 52 slope along a substantially straight line extending between the upper end 46 of rear wall 34 and the upper end 48 of front wall 28.

Figure 7:
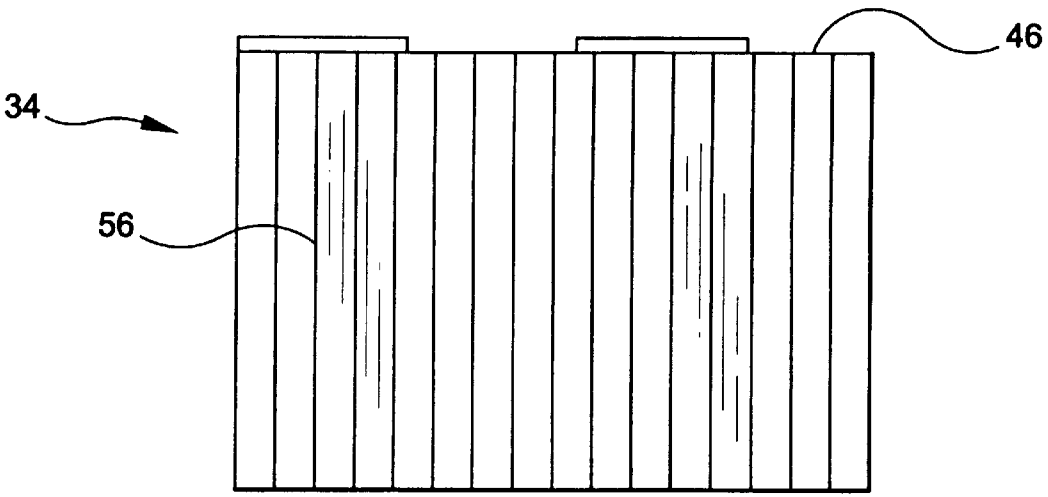
FIG. 7 shows a cross-sectional view of the container of FIG. 6 taken along lines VII—VII.

FIG. 7 shows a cross-sectional view of the container taken along lines VII—VII of FIG. 6. As shown in FIG. 7, ribs 56 extend between the upper end 46 and lower end of the rear wall 34. The ribs 56 are preferably integrally molded to the rear wall 34 and extend approximately 1–3 mm from the rear wall. In certain preferred embodiments the ribs extend from the upper end of the rear wall entirely to the lower end of the rear wall. However, in other preferred embodiments the ribs do not extend completely from the upper to the lower end of the rear wall. For example, the ribs may extend only partially between the upper and lower ends of the rear wall or may extend intermittently between the upper and lower ends of the rear wall. In still other preferred embodiments, the ribs may be provided on only one of the front or rear walls. For example, the ribs may be provided only on the interior surface of the front wall with no ribs provided on the only surface of the rear wall. In the alternative, the ribs may only be provided on the interior surface of the rear wall with no ribs provided on the front wall. Referring to FIG. 6, the interior surface 38 of the front wall includes a recessed portion 62, preferably at the upper end of the front wall, for receiving a vertically extending flange of the cap, as will be explained in more detail below.

Figure 8:
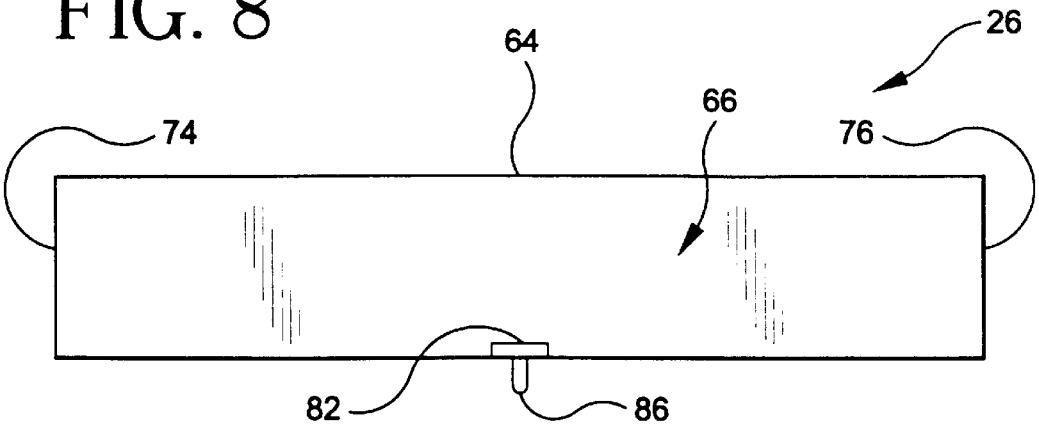
FIG. 8 shows a front view of the cap of FIG. 1.
Figure 9:
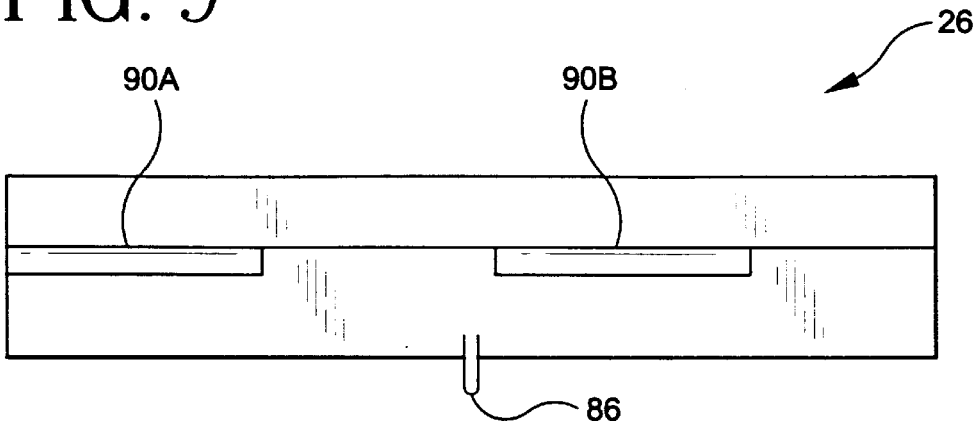
FIG. 9 shows a rear view of the cap of FIG. 8.
Figure 10:
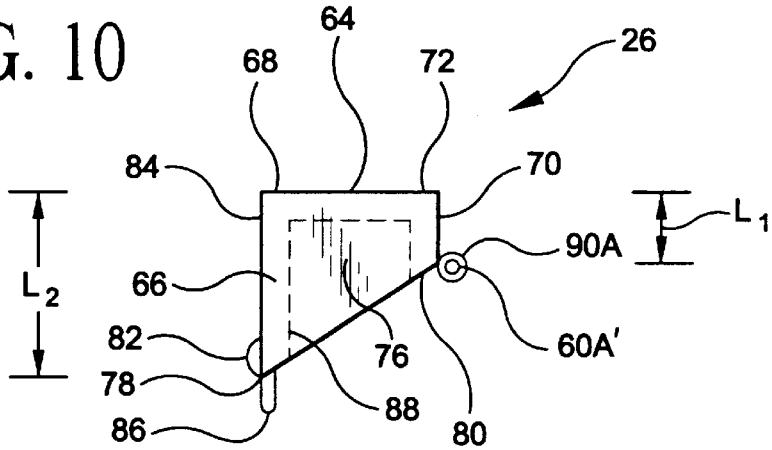
FIG. 10 shows a right side view of the cap of FIG. 8.

Referring to FIGS. 8–10, the cap 26 includes a top wall 64, a cap front wall 66 extending from a front edge 68 of the top wall, and a cap rear wall 70 extending from a rear edge 72 of the top wall 64. The cap also preferably includes a first sidewall 74 and a second sidewall 76, the first and second sidewalls extending between the cap front wall 66 and the cap rear wall 70. The height $L_1$ of the cap front wall is preferably greater than the height $L_2$ of the cap rear wall. In other words, the distance between a lower end 78 of cap front wall 66 and the top wall 64 is greater than the distance between a lower end 80 of cap rear wall 70 and the top wall 64. The cap front wall 66 preferably includes a horizontally extending flange 82 which projects from the exterior surface 84 of the cap front wall. The cap front wall 66 also includes a substantially vertically extending flange 86 that is attached to an interior surface 88 of the cap front wall 66 and which projects below the lower end 78 of the cap front wall 66. As will be explained in more detail below, the vertically extending flange 86 preferably engages the recess 62 (FIG. 7) formed in the interior surface 32 of the front wall 28 of the container when the cap is in the closed position. The engagement of the vertically extending flange 86 with the recess 62 provides a releasable snap fit engagement between the vertically extending flange 86 and the recess 62 when the cap is in the closed position. Referring to FIGS. 9 and 10, the cap also includes tubular elements 90A, 90B having central bores 60A', 60B' extending therethrough. The central bores are preferably in substantial alignment with one another.

Figure 12:
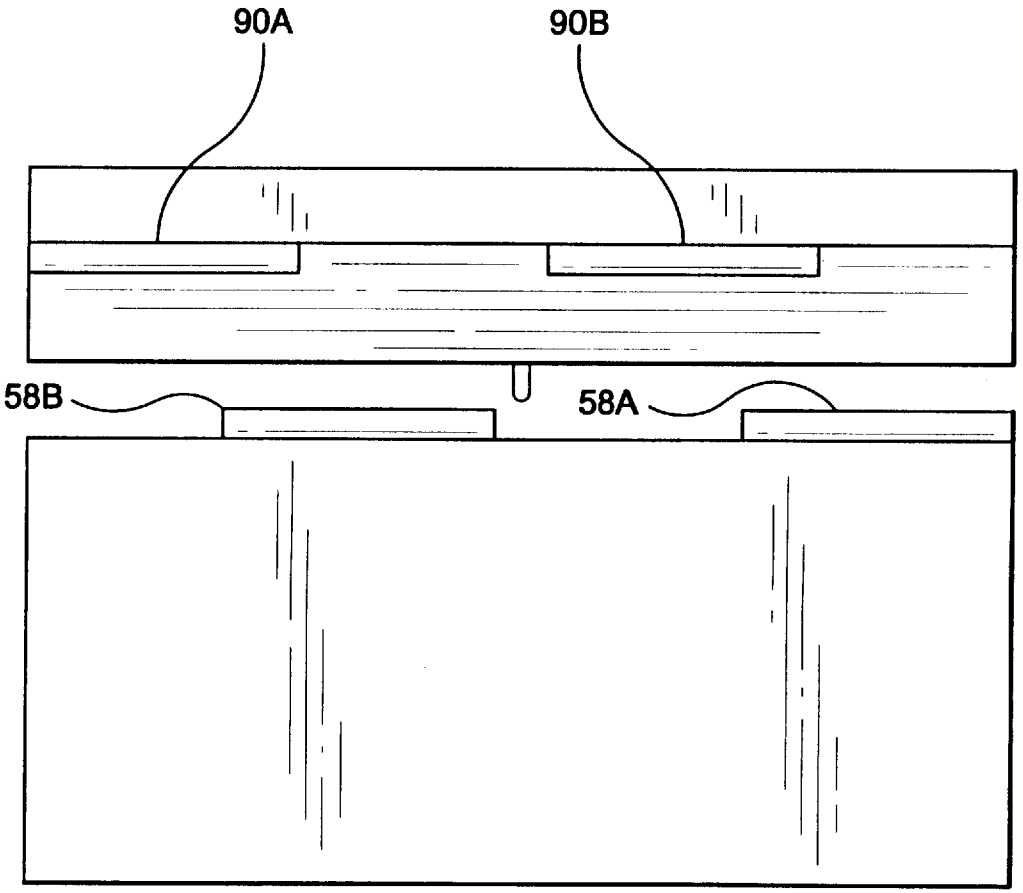
FIG. 12 shows a rear view of the reclosable package shown in FIG. 11.
Figure 11:
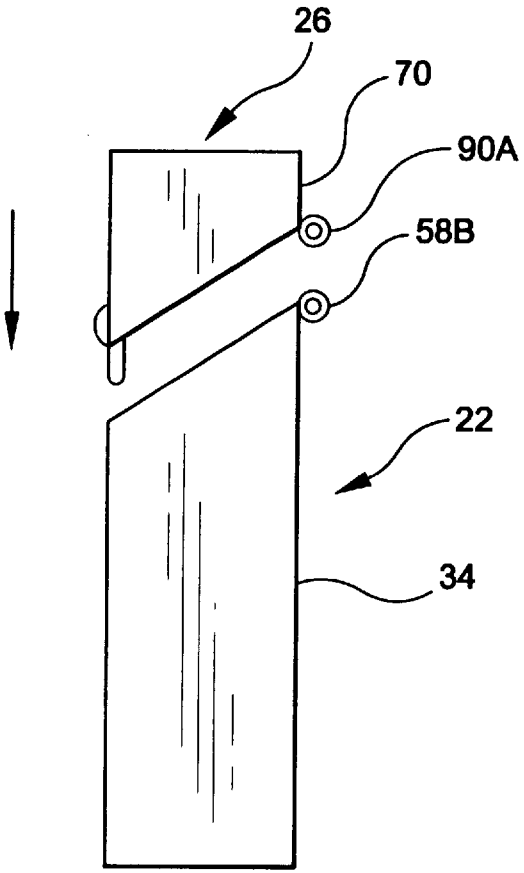
FIG. 11 shows a right side view of the reclosable package of FIG. 1 during one stage of an assembly process.
Figure 13:
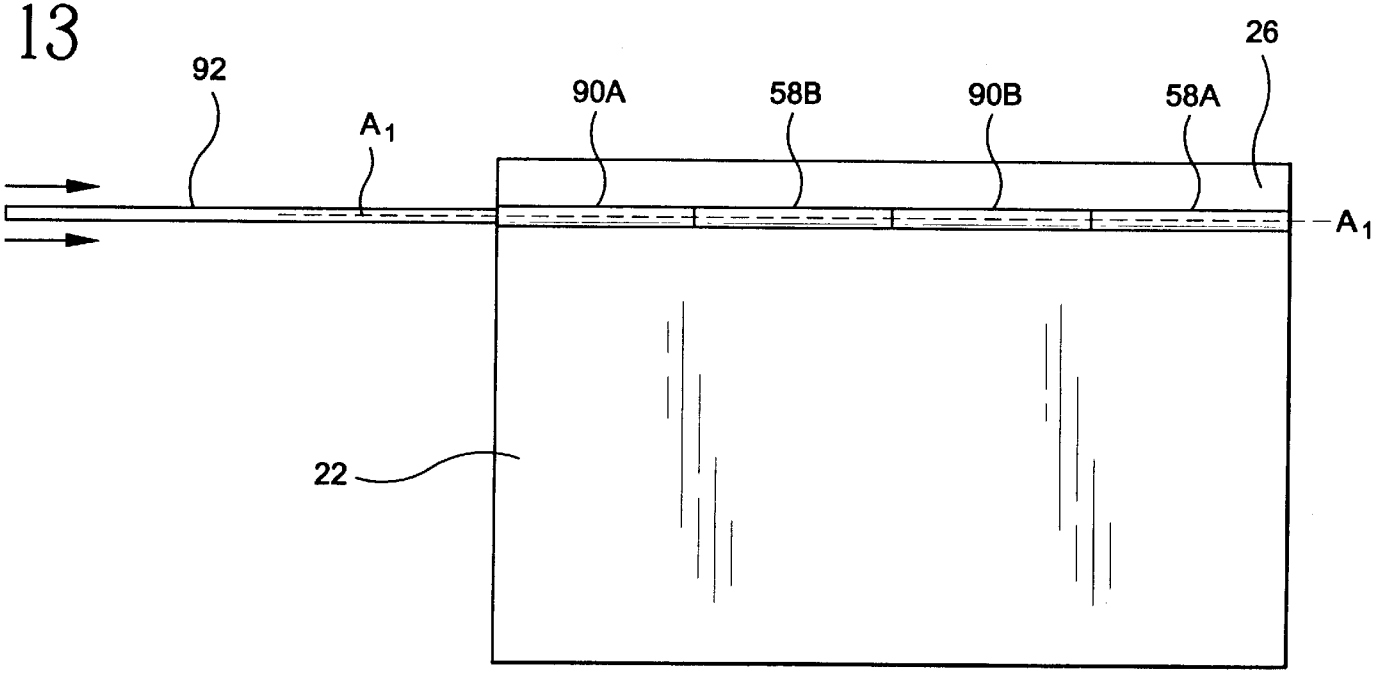
FIG. 13 shows a rear view of the reclosable package of FIG. 11 during a later stage of an assembly process.

FIGS. 11–13 shows one preferred method for assembling the cap 26 to the container 22. The rear wall 34 of the container 22 and the cap rear wall 70 are abutted against one another so that the respective tubular elements 90A, 58B, 90B and 58A intermesh with another. Referring to FIG. 13, an elongated rod 92 is then passed through the aligned bores of the tubular elements 90A, 58B, 90B, 58A for hingedly connecting the cap 26 to the container 22. The rod 92 is preferably secured in place within the aligned bores, such as by crimping the rod. As a result, the cap is hingedly secured to the container and is able to swing about an axis $A_1$ extending along the longitudinal axis of the elongated rod 92.

Figure 14:
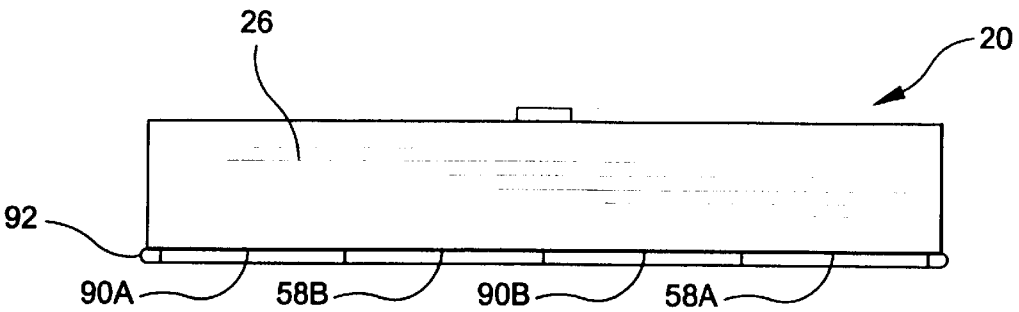
FIG. 14 shows a top view of the reclosable package shown in FIG. 1.

FIG. 14 shows a top view of the reclosable package 20 after the elongated rod 92 has been inserted into the aligned bores of the tubular elements 90A, 58B, 90B and 58A.

Figure 15:
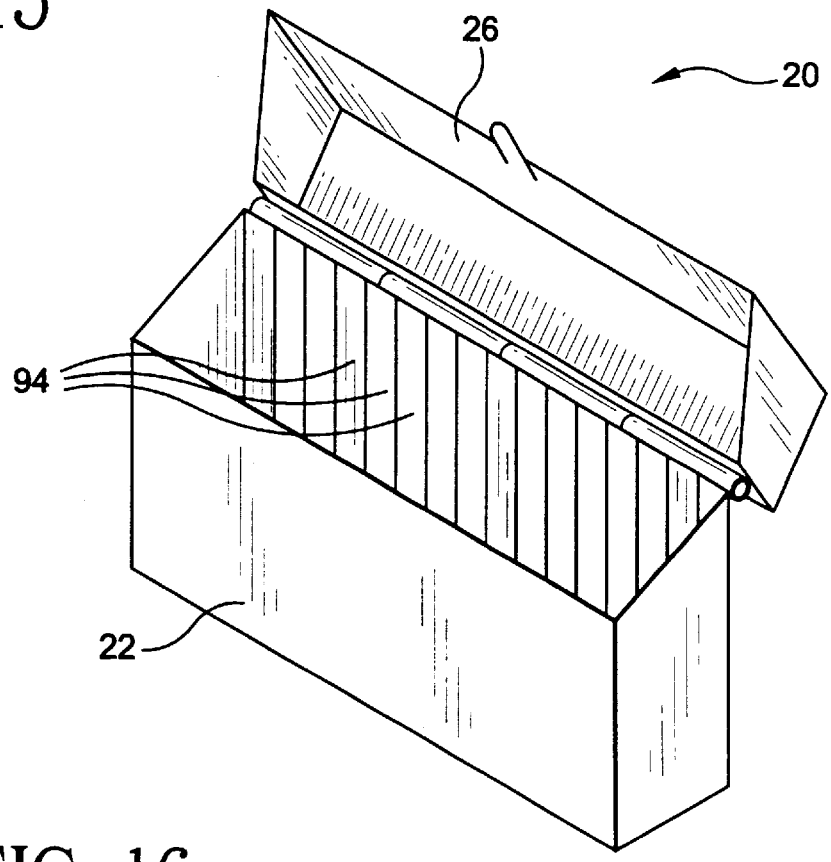
FIG. 15 shows a perspective view of the reclosable package of FIG. 1 in an open position.
Figure 16:
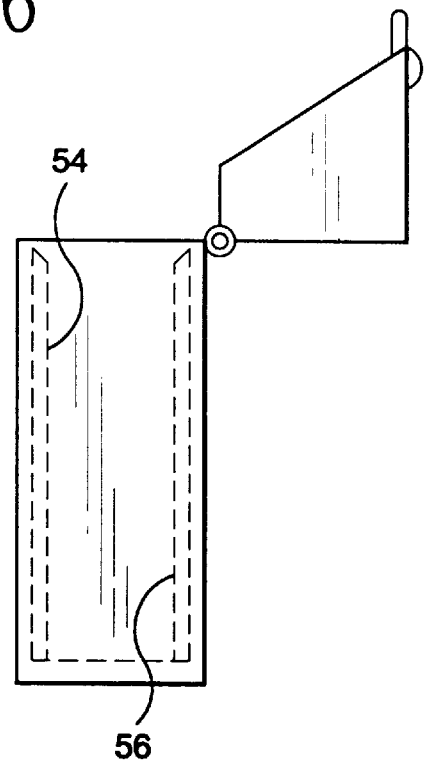
FIG. 16 shows a right side view of the reclosable package of FIG. 15.
Figure 17:
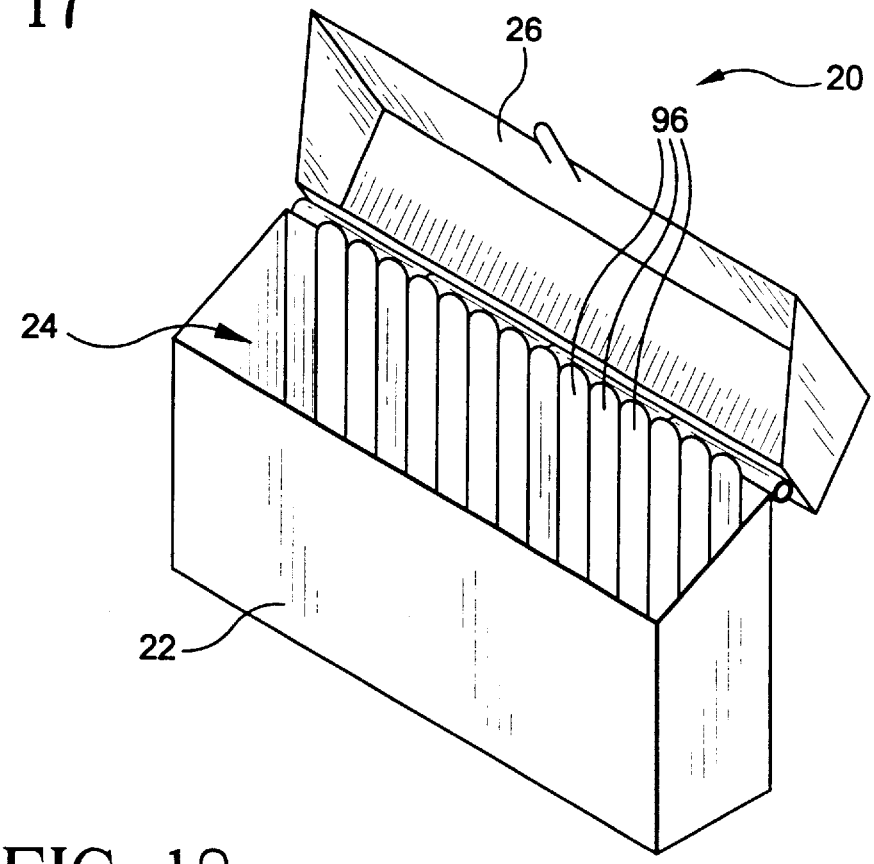
FIG. 17 shows the reclosable package of FIG. 15 with elongated items stored within the container, in accordance with certain preferred embodiments of the present invention.
Figure 18:
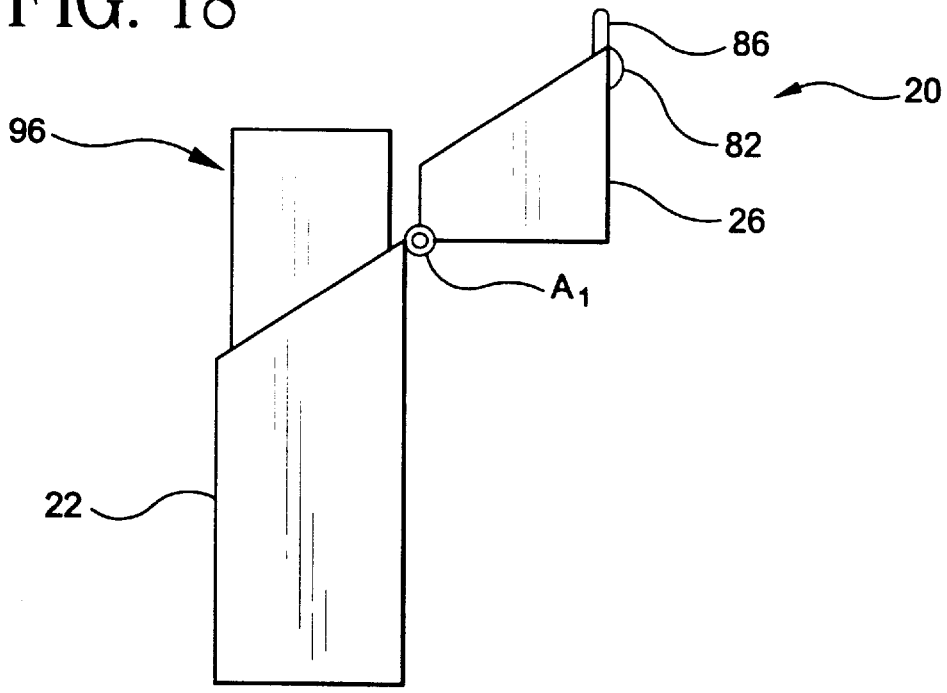
FIG. 18 shows a right side view of the reclosable package of FIG. 17.
Figure 19:
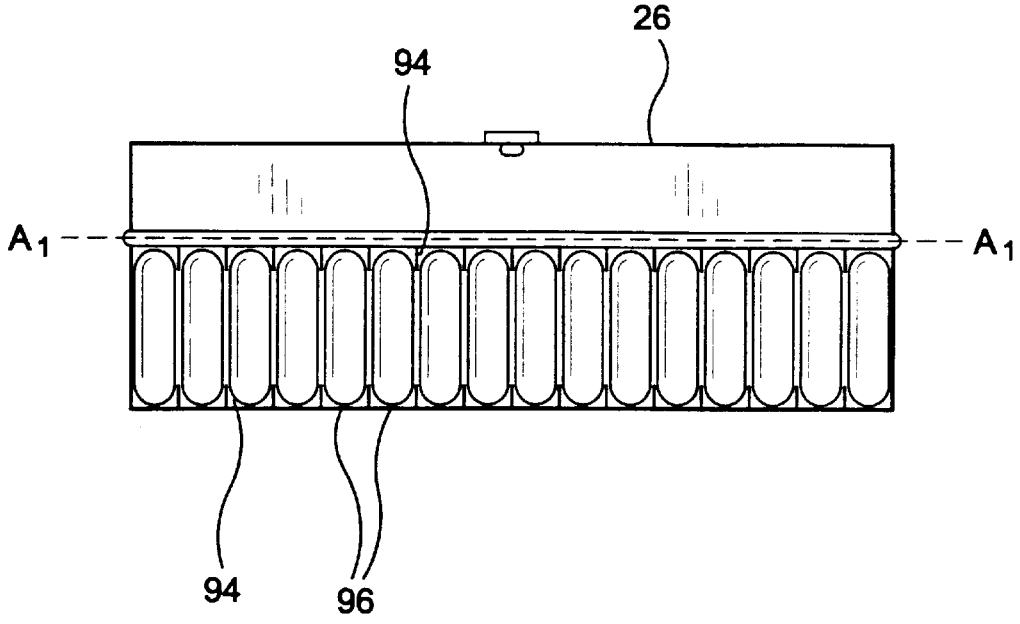
FIG. 19 shows a top view of the reclosable package of FIGS. 17 and 18 with the elongated items stored in the container.

Referring to FIGS. 15–19, after the reclosable package has been assembled, the cap 26 is movable between the completely open position shown in FIG. 15 and the closed position shown in FIG. 1. In the open position of FIG. 15, one or more sticks of gum may be placed into elongated slots 94. As mentioned above, the elongated slots are defined by the opposing ribs 54, 56. In certain preferred embodiments, the container includes approximately 10–20 elongated slots 94 for receiving and storing approximately 10–20 sticks of gum. However, preferred embodiments may include containers having two or more slots. FIGS. 17–19 show the reclosable package after sticks of gum 96 have been stored in the slots 94. After the reclosable package 20 has been completed filled with the sticks of gun, the cap 26 may be closed over the opening 24 of the container 22. The reclosable package is preferably made of a rigid material, such as a rigid polymer material. As a result, the exterior surface of the package can withstand a substantial amount of external force without those forces being transferred to the product stored within the package.

When it is desired to retrieve a stick of gum 96 from the package, a user may grasp the outer surface of the container 22 and apply pressure to the horizontally extending flange 82 so as to withdraw the vertically extending flange 86 from the recess 62 formed in the interior surface 32 of the front wall 28 of the container. The cap 26 may then be pivoted or swung to the open position shown in FIGS. 17 and 18. In this position, the opening 24 at the upper end of the container 22 is completely accessible for removing one or more sticks of gum 96 from the elongated slots 94. After one or more sticks of gum 96 have been removed from the package, the cap may once again be swung to the closed position shown in FIG. 1.

Figure 20:
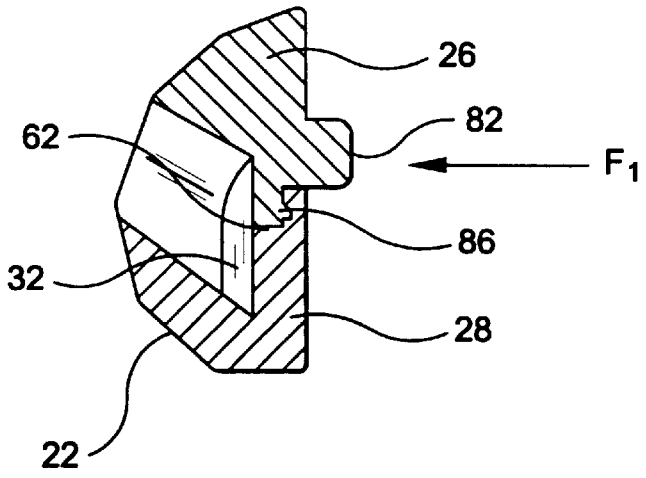
FIG. 20 shows a fragmentary cross-sectional view of the cap and container taken along line XX—XX of FIG. 1.

FIG. 20 shows a magnified fragmentary view of the cap 26 when the cap is secured to the front wall 28 of container 22. The front wall 28 of container 22 has an interior surface 32 including recess 62 formed adjacent an upper end of front wall 28. The front wall of the cap 26 includes a vertically extending flange 62 and a horizontally extending flange 82. When the cap 26 is swung into the closed position (FIG. 1), the vertically extending flange 86 fits into the recess 62 for securing the cap in the closed position. When it is desirable to open the cap, a force $F_1$, may be exerted on the horizontally extending flange 82 to urge the vertically extending flange 86 away from the recess 62. Once the vertically extending flange is away from recess 62, the cap 26 may be moved to the open position shown in FIG. 17.

Figure 22:
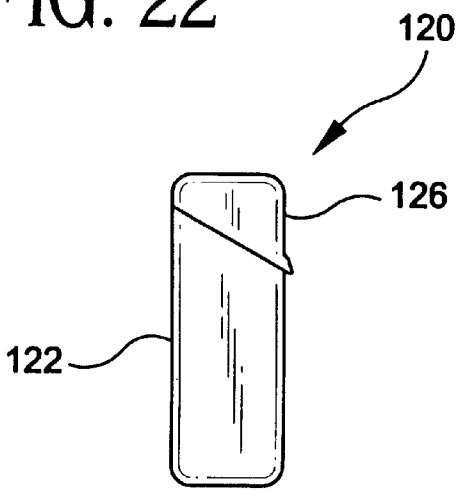
FIG. 22 shows a left side view of the package shown in FIG. 21.
Figure 21:
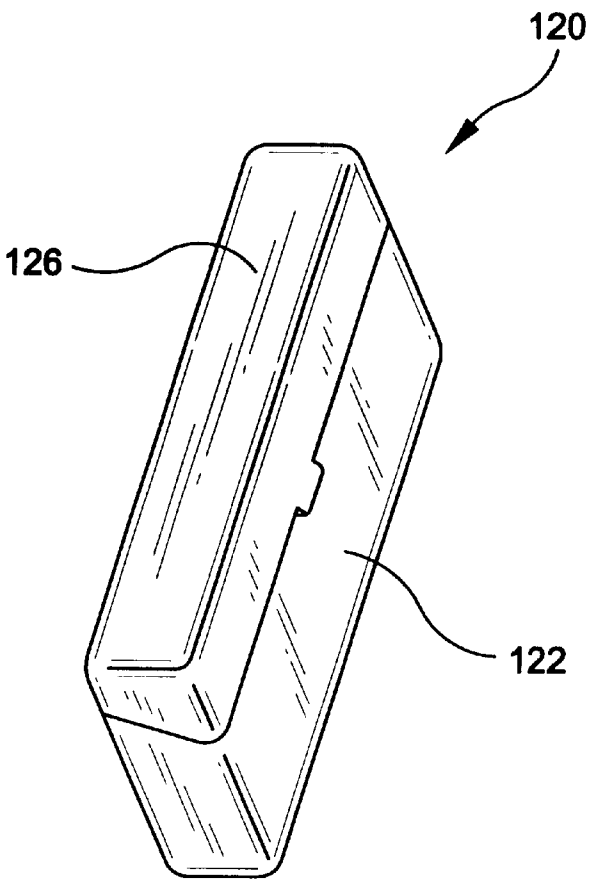
FIG. 21 shows a perspective view of a reclosable package including a container and a cap hingedly connected to the container via an integrally molded hinge, in accordance with further preferred embodiments of the invention.
Figure 24:
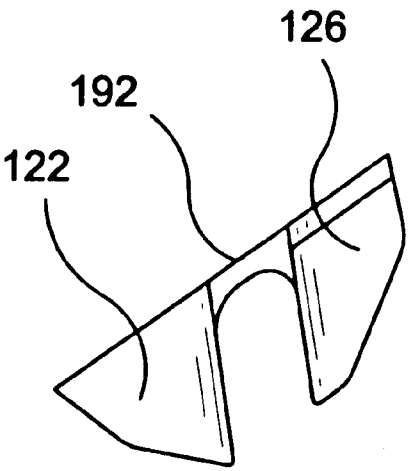
FIG. 24 shows a magnified view of the integrally molded hinge of FIG. 21.
Figure 23:
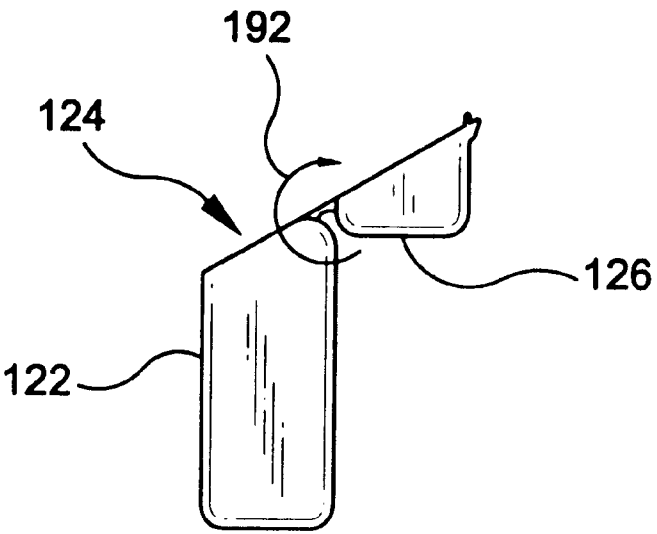
FIG. 23 shows a right side view of the package shown in FIG. 21 with the cap in the open position.

FIGS. 21–27 show a reclosable package having a cap hingedly secured to a container in accordance with further preferred embodiments of the present invention. Referring to FIGS. 21 and 22, the reclosable package 120 includes cap 126 and container 122 that are molded together in a single piece. Referring to FIGS. 23 and 24, the cap 126 is connected to the container 122 via hinge 192. Referring to FIG. 24, the hinge has a first end integrally molded to cap 126 and a second end integrally molded to container 122. The hinge 192 is made of a flexible resilient material such as plastic so that the cap 126 may be repeatedly opened and closed relative to container opening 124 (FIG. 23).

Figure 25:
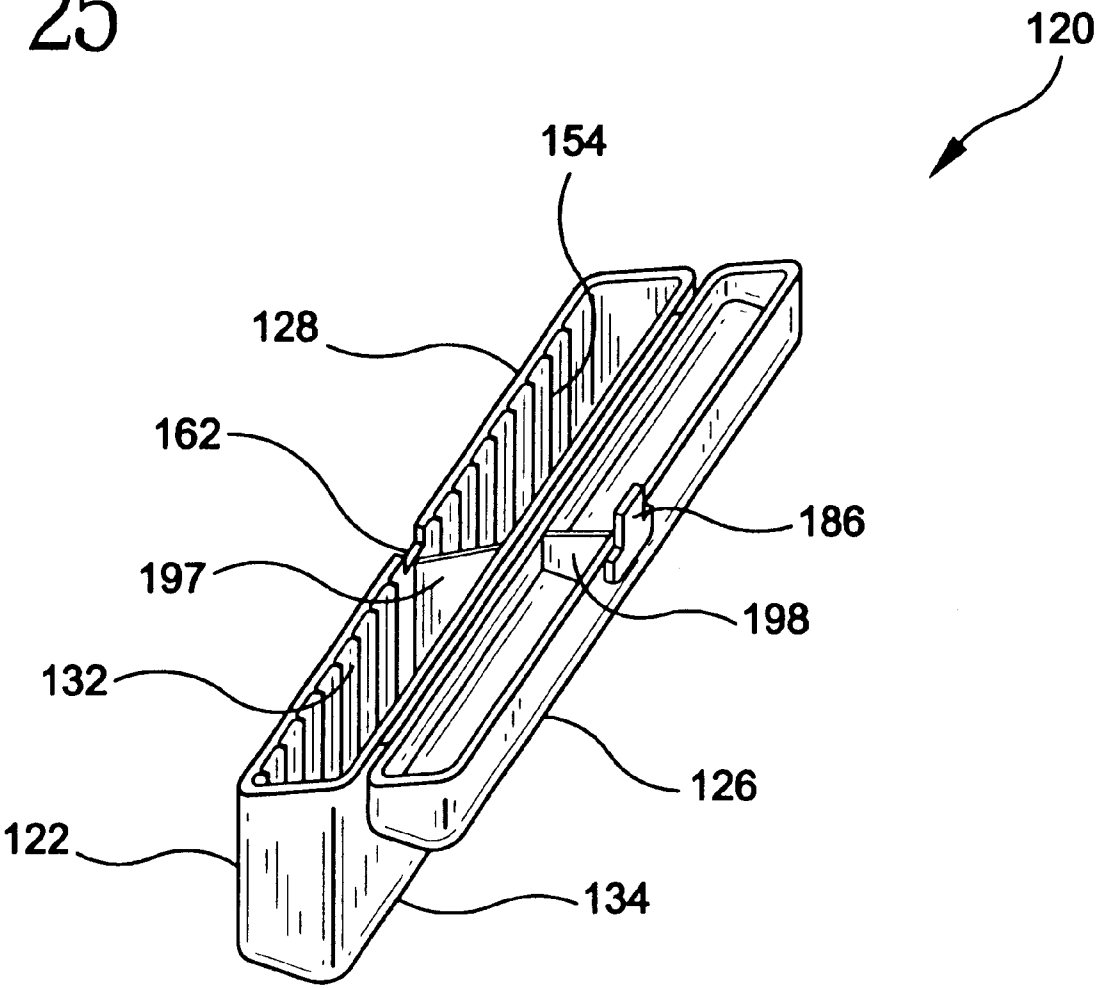
FIG. 25 shows a perspective view of the package of FIG. 23.
Figure 26:
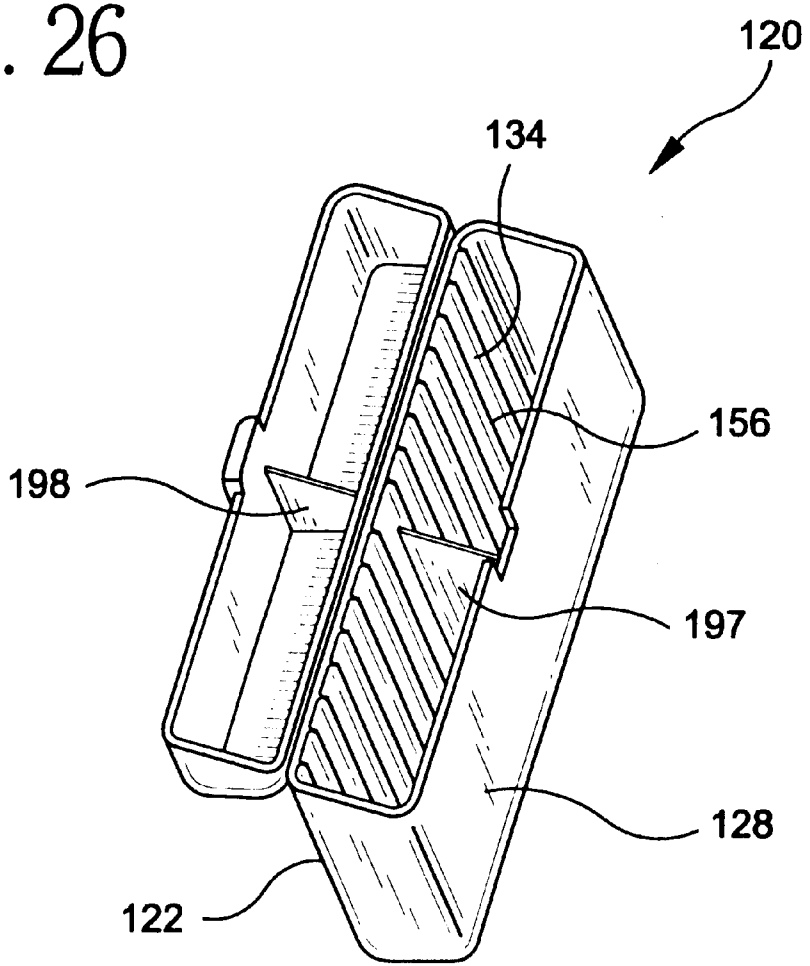
FIG. 26 shows another perspective view of the package of FIG. 23.
Figure 27:
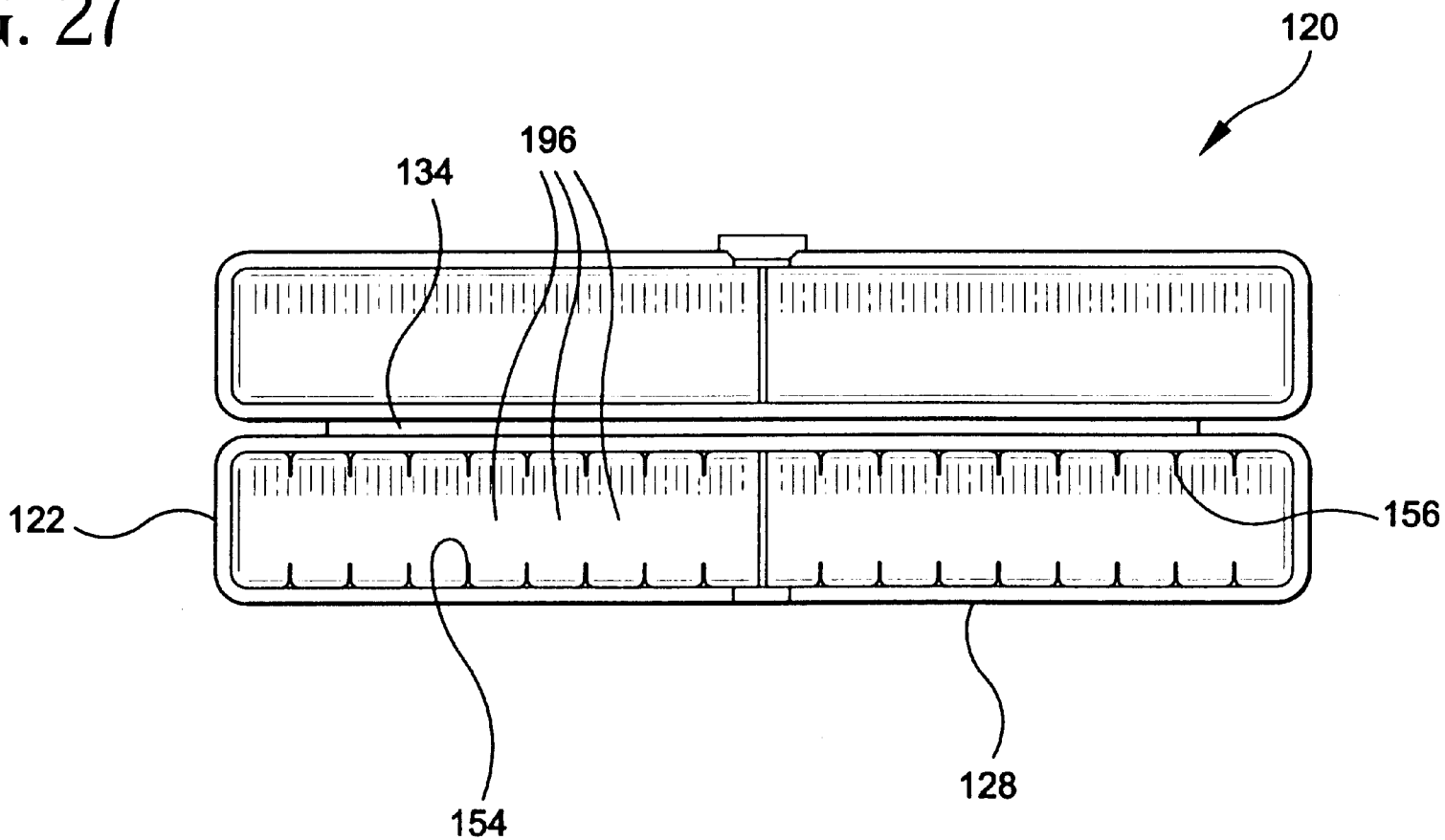
FIG. 27 shows a top plan view of the package of FIG. 23.

FIGS. 25–27 show the reclosable package in the open position. Referring to FIG. 25, the front wall 130 of container 128 has ribs 154 provided on interior surface 132 thereof. The front wall ribs 154 extend toward the rear wall 134 of container 122. The interior surface 132 of front wall 128 includes recess 162 for receiving vertically extending flange 186 of cap 126. The container includes a central support 197 extending between front wall 128 and rear wall 134. The central support 197 adds rigidity to the container 122. The underside of cap 126 also includes a central support 198 for adding rigidity to the cap. Referring to FIG. 26, rear wall 134 of container 122 includes a series of vertically extending ribs 156 which project toward front wall 128 of container 122. Referring to FIG. 27, the front wall ribs 154 and the rear wall ribs 156 are in substantial alignment with one another. The ribs define a series of slots 196 that extend between the front wall 128 and the rear wall 134 of the container 122. The container 122 shown in of FIG. 27 has 18 slots for receiving elongated items such as sticks of gum. However, preferred embodiments of the present invention may include anywhere from two slots to an infinite number of slots for receiving elongated items.

Figure 28:
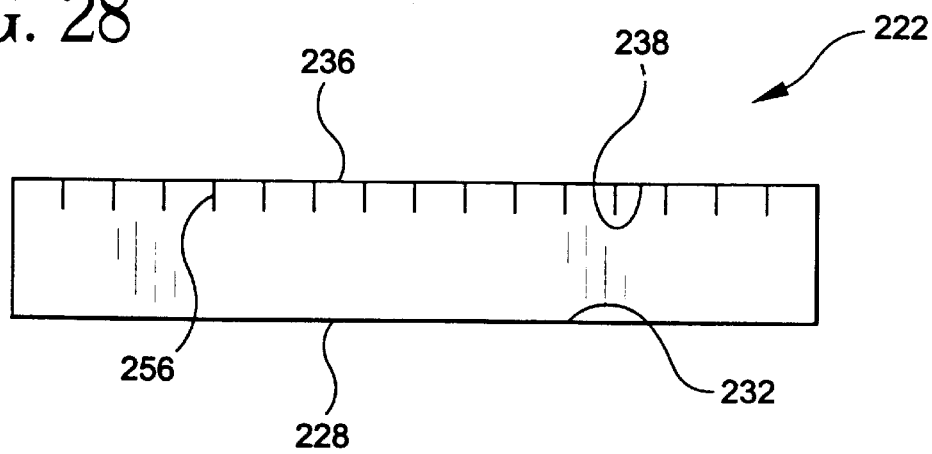
FIG. 28 shows a top view of a container for a reclosable package in accordance with further preferred embodiments of the present invention.

FIG. 28 shows another alternate embodiment of the present invention wherein ribs are provided on either the front wall or the rear wall of the container. In the particular embodiment shown in FIG. 28, the ribs 256 are provided on the interior surface 238 of the rear wall 236 of the container 222 and no ribs are provided upon the interior surface 132 of the front wall 228. However, in other embodiments, ribs may be provided on the front wall 228 and not rear wall 236.

Figure 29:
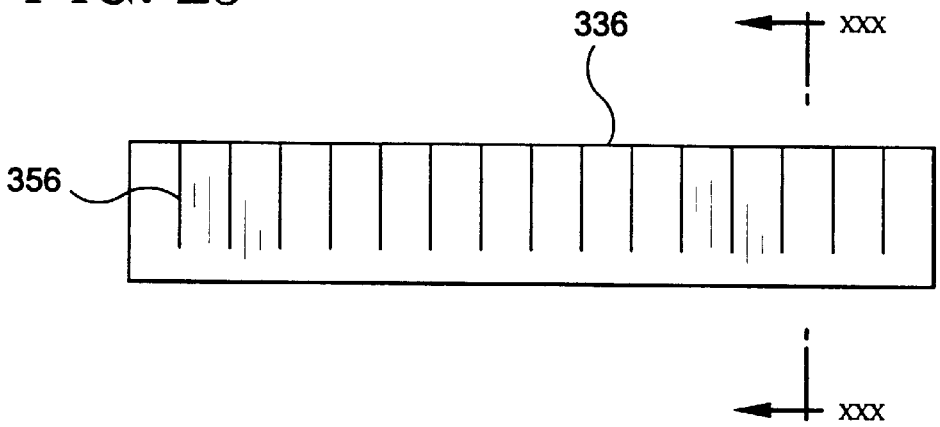
FIG. 29 shows a top view of a container for a reclosable package in accordance with still further preferred embodiments of the present invention.
Figure 30:
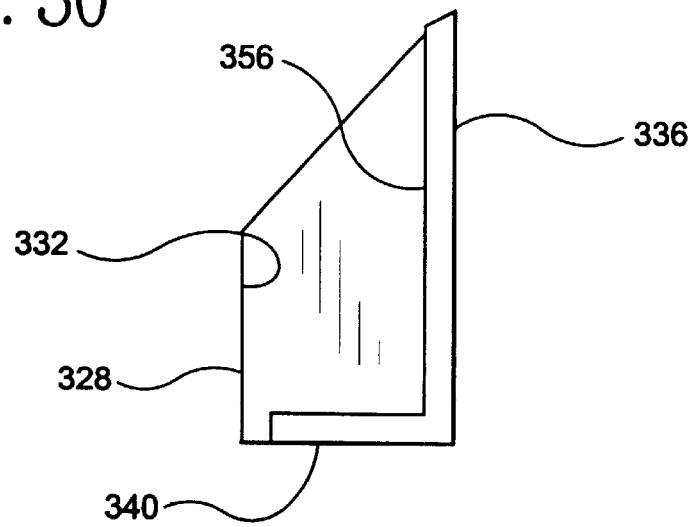
FIG. 30 shows a cross-sectional view of the container of FIG. 29 taken along line XXX—XXX of FIG. 29.

FIGS. 29 and 30 show another embodiment of the present invention wherein ribs 356 are provided on the interior surface of the rear wall 336 and on the upper surface of bottom wall 340. The ribs 356 extend above the interior surface of the front wall 336 and the interior surface of the bottom wall 340. The interior surface 332 of the front wall 328 has no ribs.

Although the present invention has been described with reference to particular preferred embodiments, it is to be understood that the embodiments are merely illustrative of the principles and application of the present invention. For example, a wide variety of confectionery items such as candy or mints may be stored in the package. In addition, the package of the present invention could be used to store medicine, such as pills. It is therefore understood that numerous modifications may be made to the preferred embodiments of the present invention without departing from the spirit and scope of the present invention as defined by the claims.

What is claimed is:

1. A reclosable package comprising:

elongated chewing gum sticks;

a container having a bottom wall and side walls extending from said bottom wall that surround an interior region of said container, wherein said side walls have upper ends remote from said bottom wall defining an opening of said container said side walls comprising a front wall, a rear wall and first and second walls with the front and rear walls including interior surfaces facing one another;

one or more dividers integral with at least one of the walls disposed in the interior region of said container and extending between the container opening and said bottom wall and including a first set of spaced ribs extending from the interior surface of the front wall toward said rear wall, wherein said or more integral dividers define elongated slots adapted to receive and retain the chewing gum sticks in an upright position within the container; and a cap attached to the container and closable over the opening to maintain the freshness of the chewing gum sticks.

2. The package as claimed in claim 1, wherein said reclosable package is made of a rigid polymer material.

3. The package as claimed in claim 1, wherein said cap is attached to one of the sidewalls of said container.

4. The package as claimed in claim 1, wherein the cap is attached to one of the upper ends of one of the sidewalls of said container.

5. The package as claimed in claim 1, wherein said cap is hingedly connected to said container via an integrally molded hinge.

6. The package as claimed in claim 1, wherein the cap is hingedly secured to one of the upper ends of one of the sidewalls of said container.

7. The package as claimed in claim 1, wherein said one or more dividers further comprises a second set of spaced ribs extending from the interior surface of said rear wall toward said front wall.

8. The package as claimed in claim 7, wherein each said rib of the first set of spaced ribs is in substantial alignment with one of the ribs of the second set of spaced ribs.

9. The package as claimed in claim 7, wherein said ribs extend about 1–3 mm from the respective interior surfaces of said front and rear walls.

10. The package as claimed in claim 7, wherein said ribs extend from the upper ends of said front and rear walls to the bottom wall.

11. The package as claimed in claim 1, wherein the distance between the bottom wall and an upper end of the rear wall is greater than the distance between the bottom wall and an upper end of the front wall.

12. The package as claimed in claim 1, wherein said side walls have upper ends that slope downwardly from the upper end of said rear wall to the upper end of said front wall.

13. The package as claimed in claim 1, wherein said cap includes a top wall, a cap front wall extending from a front edge of said top wall, a cap rear wall extending from a rear edge of said top wall, and first and second cap side walls extending between the cap front wall and the cap rear wall.

14. The package as claimed in claim 13, wherein the cap rear wall is hingedly connected to the rear wall of said container.

15. The package as claimed in claim 14, wherein said cap is movable between a closed position and a fully open position.

16. The package as claimed in claim 15, wherein the top wall of said cap is substantially parallel to the bottom wall of said container when said cap is in the closed position.

17. The package as claimed in claim 15, wherein the top wall of said cap has an exterior surface that faces toward the bottom wall of said container when said cap is in the fully open position.

18. The package as claimed in claim 17, wherein the cap front wall has a lower end remote from the top wall, said lower end of the cap front wall engaging the upper end of said container front wall when said cap is in the closed position.

19. The package as claimed in claim 18, wherein said cap rear wall has a lower end remote from the top wall.

20. The package as claimed in claim 19, wherein the distance between the top wall and the lower end of the cap front wall is greater than the distance between the top wall and the lower end of the cap rear wall.

21. The package as claimed in claim 20, wherein the lower end of the cap front wall includes a flange projecting therefrom that is engagable with the front wall of the container for holding the cap in the closed position.

22. The package as claimed in claim 21, wherein the interior surface of the front wall of the container includes a recessed section for receiving the flange of the cap when said cap is in the closed position.

23. The package as claimed in claim 20, wherein the cap is hingedly connected to the container by a hinge subassembly.

24. The package as claimed in claim 20, wherein the cap is hingedly connected to the container by an integrally molded hinge.

25. The package as claimed in claim 23, wherein the hinge subassembly includes:

one or more tubular sections connected to the lower end of the rear wall of the cap;

one or more tubular sections connected to the upper end of the rear wall of the container, wherein each said tubular section includes an elongated bore extending therethrough, said elongated bores being in substantially alignment with one another; and an elongated rod extending through the aligned elongated bores of said tubular sections for enabling said cap to swing relative to said container.

26. A reclosable package for storing chewing gum, comprising:

elongated chewing gum sticks;

a container having an opening for accessing an interior region of said container, said container having side walls surrounding the interior region of said container and extending from the opening toward a bottom wall of said container;

one or more dividers integral with at least one of said walls disposed in the interior region of said container and extending between the container opening and said bottom wall and including a first set of spaced ribs extending from an interior surface of a first side wall toward an interior surface of a second opposing side wall, said one or more integral dividers defining elongated slots adapted for receiving and retain the chewing gum sticks in an upright position within the container; and a cap hingedly connected to one of the side walls of said container, said cap being movable between a closed position for covering the chewing gum sticks to maintain freshness and an open position for accessing the elongated items.

27. The package as claimed in claim 26, wherein said cap and said container are molded together as one piece.

28. The package as claimed in claim 27, wherein said cap and said container are hingedly connected together via an integrally molded hinge.

29. The package as claimed in claim 26, wherein said one or more dividers further comprise a second set of spaced ribs extending from the interior surface of the second sidewall toward the first sidewall.

30. The package as claimed in claim 29, wherein each one of the first sets of spaced ribs is in substantial alignment with one of the second set of spaced ribs.

31. The package as claimed in claim 29, wherein said ribs extend about 1–3 mm from the respective interior surfaces of said first and second side walls.

* * * * *

UNITED STATES PATENT AND TRADEMARK OFFICE

CERTIFICATE OF CORRECTION

PATENT NO. : 6,709,684 B2
DATED : March 23, 2004
INVENTOR(S) : Jeffrey Loth

It is certified that error appears in the above-identified patent and that said Letters Patent is hereby corrected as shown below:

Column 9,
Line 21, remove the number "1" after the word "claim" and insert number -- 11 --;

Column 10,
Line 55, remove "set" and insert -- sets --.

Signed and Sealed this

Twenty-ninth Day of June, 2004

JON W. DUDAS
*Acting Director of the United States Patent and Trademark Office*